US007452458B2

(12) United States Patent
Sanchez et al.

(10) Patent No.: US 7,452,458 B2
(45) Date of Patent: Nov. 18, 2008

(54) PROCESS FOR THE TREATMENT OF A HYDROCARBON FEEDSTOCK

(75) Inventors: Eric Sanchez, Rueil Malmaison (FR); Béatrice Fischer, Lyons (FR)

(73) Assignee: Institute Francais du Petrole, Rueil Malmaison Cedex (FR)

( * ) Notice: Subject to any disclaimer, the term of this patent is extended or adjusted under 35 U.S.C. 154(b) by 479 days.

(21) Appl. No.: 11/194,592

(22) Filed: Aug. 2, 2005

(65) Prior Publication Data

US 2006/0021914 A1 Feb. 2, 2006

(30) Foreign Application Priority Data

Aug. 2, 2004 (FR) ..... 04 08547

(51) Int. Cl.
*C10G 5/04* (2006.01)
*C10G 5/00* (2006.01)
*C10G 5/06* (2006.01)

(52) U.S. Cl. ..... 208/104; 208/100; 208/101; 208/102; 208/103; 208/105; 208/341; 208/342; 208/343; 208/346

(58) Field of Classification Search ..... 208/46, 208/95, 100, 101, 102, 103, 104, 105, 308, 208/340, 341, 342, 343, 344, 345, 346
See application file for complete search history.

(56) References Cited

U.S. PATENT DOCUMENTS 4,212,726 A * 7/1980 Mayes ..... 208/101
4,333,820 A 6/1982 Scheifele, Jr. et al.

* cited by examiner

*Primary Examiner*—Glenn Caldarola
*Assistant Examiner*—Randy Boyer
(74) *Attorney, Agent, or Firm*—Millen, White, Zelano & Branigan, P.C.

(57) ABSTRACT

Process for treatment of a hydrocarbon feedstock that comprises a hydrocarbon-containing liquid phase and hydrogen, in which the feedstock is separated under a pressure P1 into a liquid L1 and a gas G1, that is compressed and brought into contact with a portion of L1 under a pressure P2>2×P1 to recover a liquid L2 and a hydrogen-rich gas G2; L2 is fractionated to obtain a stabilized liquid L4*a* that is free of LPG and lighter products, a liquid stream of LPG, and a gas stream G4 that is recycled, and in which one of gas streams: recompressed G1 and G4 is in counter-current contact with an unstabilized liquid AL that is obtained from or extracted from L1 or L2, whereby this unstabilized liquid is supercooled by at least 10° C. below its bubble point at pressure P2.

17 Claims, 1 Drawing Sheet

PROCESS FOR THE TREATMENT OF A HYDROCARBON FEEDSTOCK

FIELD OF THE INVENTION

Figure 1:
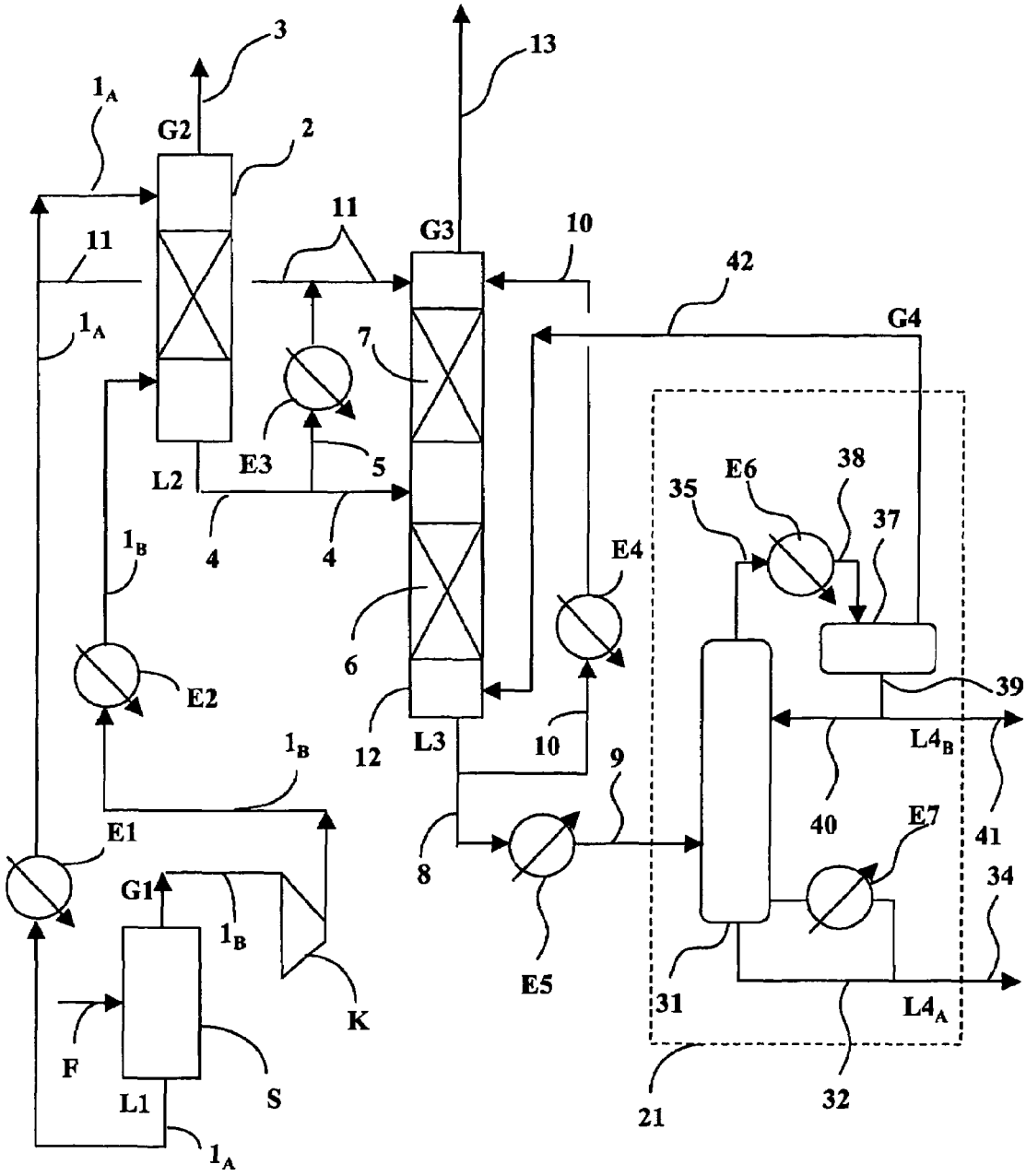

The invention relates to the field of treatments of effluents of petroleum or petrochemical refining or conversion units, whose effluents comprise both hydrogen and hydrocarbons such as: methane, ethane, propane, butane, fractions of hydrocarbons that have 5 to 11 carbon atoms (designated by $C_5$-$C_{11}$), and optionally heavier hydrocarbons such as hydrocarbons that have between 12 and 30 carbon atoms ($C_{12}$-$C_{30}$) and even more, often in a small quantity.

It can also involve in particular the treatment of an effluent from catalytic reforming or aromatization of fractions that boil in the field of gasoline (that have essentially 6 to 11 carbon atoms), making it possible to recover an aromatic reformate, a hydrogen-rich gas, and a liquefied petroleum gas (product that we will designate by "LPG," essentially comprising hydrocarbons with three or four carbon atoms: propane and/or propylene and/or butane and/or butenes and/or butadiene, as well as mixtures thereof). In the case of catalytic reforming, the LPG essentially consists of saturated compounds: propane and butane.

The invention is also applicable to effluents from dehydrogenation of, for example, butane, or pentane or higher hydrocarbons, for example fractions that essentially comprise hydrocarbons that have 10 to 14 carbon atoms, of which the olefins are used downstream for the production of linear alkylbenzenes (commonly called LAB). The process according to the invention can also be applied to the hydrotreatment (and/or hydrodesulfurization and/or hydrodemetallization and/or total or selective hydrogenation) of all hydrocarbon fractions such as naphtha, gasoline, kerosene, light gas oil, heavy gas oil, vacuum distillate, and vacuum residue. More generally, it is applicable to any effluent that comprises hydrogen as well as light hydrocarbons (methane and/or ethane), LPG, as well as heavier hydrocarbons.

The invention will be described below, in a nonlimiting way, essentially within the framework of catalytic reforming.

PRIOR ART

It is known to treat a hydrocarbon feedstock so as to recover a hydrogen-rich gas, LPG, and a hydrocarbon-containing liquid, for example in the case of the treatment of catalytic reforming effluents.

Typically three objectives are sought in addition to the production of stabilized reformate, fuel base with high octane rating:

a) To separate excess high-purity purging gas into hydrogen, usable for various refining processes;

b) To separate the LPG fractions, of relatively high value, from lighter hydrocarbon fractions (methane, ethane), and purging gas;

c) To isolate the largest quantity possible of these light fractions, which are separated from hydrogen-rich gas, on the one hand, and LPG, on the other hand, to send them into the fuel gas network.

The purpose is then to maximize the recovery of LPG and to minimize the losses of propane and butane that are allowed in the fuel gas.

The purging gases are used to eliminate excess hydrogen that is optionally produced by the chemical reaction, and in this case, an effort is made to recover this high-purity hydrogen to facilitate its use downsteam. The purging gases are also sometimes used, even when the chemical reaction consumes hydrogen, to keep adequate hydrogen purity in the reaction loop by evacuating light hydrocarbons: methane, ethane, propane, and even butane, which tend to accumulate in this reaction loop.

A problem that is posed by those techniques of the prior art that comprise intense elimination of light compounds (methane and/or ethane), so as to increase the purity of the hydrogen, is that a significant quantity of LPG is evacuated with the light gaseous effluent that is obtained during the stage for separation of recovered condensates, downstream from the recovery of the hydrogen-rich gas. The gaseous effluent that contains these significant quantities of liquefied petroleum gas (LPG) is often used as fuel in the refinery. More advantageous uses of the liquefied petroleum gas than its simple immediate consumption as fuel exist, however. LPG is also often lost or allowed into the hydrogen-rich purified gas, which is harmful from the standpoint of the purity of the hydrogen.

U.S. Pat. No. 4,673,488 describes a method for treatment of an effluent that is obtained from a conversion zone that makes it possible to increase the recovery of butane and propane. In this method, the effluent is subjected to a separation that makes it possible to recover liquid and gas compounds, whereby said compounds undergo several stages of contact at increasing pressures. A liquid product that is obtained from the separation and the contact stages is fractionated so as to recover a top gas that is recycled in the contact stages. This recycling in the contact stages makes it possible to recover LPG and to transfer compounds of intermediate boiling point that are initially contained in this top gas in the hydrogen-rich gaseous effluent (H2). It does not comprise elimination of compounds with an intermediate boiling point of between light gas (H2) and LPG, i.e., methane- and/or ethane-rich gas. The purity of the hydrogen is therefore limited, because the latter comprises the largest portion of methane and ethane. In addition, the contact is made at ambient temperature. Further, the separation arrangement is relatively complex.

In other known processes, the hydrocarbon effluent is sent, after recovery of a hydrogen-rich gas, into a stage for separation so as to separate a first gaseous effluent from a liquid effluent, and this liquid effluent is sent into a stage for stabilization during which a stabilized reformate, a liquefied petroleum gas, and a second gaseous effluent that is itself recycled upstream from the separation stage are recovered. The first gaseous effluent that is obtained during the separation stage, which contains significant quantities of LPG, is conventionally used as a fuel. The term "stabilized," for a reformate (or another stabilized liquid according to the invention), designates a reformate (or other liquid) that has been distilled to eliminate the largest portion, and generally approximately all compounds with 4 carbon atoms or less (C4−). It typically contains less than 0.3% by weight, often less than 0.2% by weight and generally less than 0.1% by weight of compounds with 2 carbon atoms or less (C2−). It typically contains less than 0.8% by weight, often less than 0.5% by weight, and generally less than 0.3% by weight of compounds with 3 carbon atoms or less (C3−). It typically contains less than 1.5% by weight, often less than 1% by weight and generally less than 0.6% by weight of compounds with 4 carbon atoms or less (C4−).

It has already been proposed to contact the first gaseous effluent by the stabilized reformate, but this technical option is expensive at the level of the reformate/LPG downstream fractionation. Actually, it then is necessary to re-distill the recovered LPG-enriched reformate.

SUMMARY DESCRIPTION OF THE INVENTION

The process according to the invention makes it possible, in an economical manner, to maximize the recovery of liquefied petroleum gas (LPG) in liquid form and to minimize the losses of LPG left in the hydrogen-rich gaseous effluents (purging of high-purity hydrogen) or in the gas that is used as fuel gas, high in light compounds (methane, ethane). This is finally carried out without oversizing the final distillation column (stabilization of the reformate).

Contact of LPG-rich gases with stabilized reformate (from which LPG and lighter compounds have been removed, which makes good LPG absorption liquid thereof) is a logical and natural technical option for recovering LPG and is effectively efficient: the more stabilized the reformate, the larger its LPG absorption capacity. It has been found according to the invention, however, that this technical option also resulted in a significant collection of light compounds (methane, ethane), as well as an oversizing of the distillation column that carries out the stabilization of the reformate.

The invention therefore proposes bringing into contact in particular LPG-rich gases with unstabilized reformate, which is carried out in countercurrent, and with reformate that is cooled below its bubble point and preferably below the ambient temperature, and which makes it possible both to recover a large portion of the LPG and to eliminate light compounds, without oversizing the distillation column of the reformate.

SUMMARY DESCRIPTION OF FIG. 1

FIG. 1 shows a simplified installation of the process according to the invention, applied to the treatment of effluents of catalytic reforming of hydrocarbons. FIG. 1 comprises several optional elements, corresponding to several variants of the process according to the invention.

DETAILED DESCRIPTION OF THE INVENTION

The invention proposes a process for the treatment of a hydrocarbon feedstock that comprises a hydrocarbon liquid phase and a hydrogen-rich gaseous phase, in which:

a) The feedstock is separated in a liquid L1 and a gas G1, under a pressure P1, b) At least a portion of G1 is compressed to obtain a gas stream G1* that is then brought into contact with at least a portion of L1 under a pressure P2>2×P1, so as to recover a liquid L2 and a hydrogen-rich gas G2, c) L2 is then fractionated to obtain at least: a stabilized liquid L4*a* that is essentially free of LPG and lighter products, a light liquid stream L4*b* that essentially comprises LPG, and a gas stream G4 that is at least partly recycled, and in which at least one of the gas streams of the group that consists of G1* and G4 is brought into counter-current contact with an unstabilized liquid AL (or AL1 or AL2) that is obtained or extracted from L1 or L2, whereby this unstabilized liquid is supercooled by at least 10° C., and preferably by at least 20° C., or even at least 30° C. or 50° C. below its bubble point at contact pressure.

The temperature of AL (or AL1 or AL2) is typically less than the ambient temperature, in particular between −20° C. and +20° C., preferably less than or equal to +10° C., and very preferably less than or equal to 0° C., for example between −15° C. and 0° C.

According to a first variant of the process according to the invention, LPG is recovered by absorption, carried out on recompressed gas G1*, by an unstabilized and cooled reformate: G1*, optionally precooled by itself or mixed with a portion of L1, is treated to carry out a first recovery of LPG, by counter-current contact with an unstabilized liquid AL1 that consists of at least a portion of L1, whereby AL1 is cooled below +10° C. and supercooled by at least 30° C., and preferably by at least 50° C. below its bubble point at the contact pressure. The supercooling of AL1 is typically between 30° C. and 200° C. and often between 60° C. and 140° C.

According to a preferred embodiment of this first variant of the process according to the invention, gas G1* is first precooled in a mixture with a first portion of L1, at a temperature that is less than or equal to +20° C. and preferably +10° C., to carry out a first absorption of LPG, and the residual gas, after separation from the liquid that is contained in the cooled mixture, is brought into counter-current contact with an unstabilized liquid AL1 that consists of a second portion of L1, whereby AL1 is cooled below +10° C. and preferably 0° C., and supercooled by at least 30° C., and preferably by at least 60° C. below its bubble point at the contact pressure. Thus, the scope of the invention is not exceeded when it is not stream G1* that is directly contacted, but rather G1* after first contact (in a mixture or in counter-current), for a preliminary recovery of LPG on G1*. The first portion of L1 typically represents between 50 and 92% by weight of L1 and preferably between 70% and 85% by weight of L1. The second portion of L1 (AL1) typically represents between 5 and 50% by weight of L1 and preferably between 10% and 35% by weight of L1.

According to a second variant of the process according to the invention that can be used separately or simultaneously with the first variant, LPG is recovered by absorption, carried out on gas G4: liquid L2 as well as at least a fraction of stream G4 is sent in gas/liquid counter-current contact means (12) by a supercooled liquid AL2 for absorption of LPG so as to recover a liquid effluent L3 and a gas G3, whereby this liquid AL2 is an unstabilized liquid of the group that consists of one or more of the following liquids and their fractions: L1, L2, L3, then liquid L3 is fractionated by distillation(s) to obtain said stabilized liquid L4*a*, whereby said light liquid stream L4*b* essentially comprises LPG and said gas stream G4 that is at least partly recycled, for its contact.

Absorption liquid AL2 is typically supercooled to a temperature that is at least 20° C. below its bubble point at the contact pressure. The supercooling of AL2 is typically between 20° C. and 200° C.; it is often included between 60° C. and 140° C. when AL2 is a portion of L1 (for example, third portion), and often included between 20° C. and 80° C. when AL2 is a portion of L2 or L3.

Absorption liquid AL2 preferably comprises or consists of a fraction of liquid L1 that represents 3% to 40% by weight of L1, and very preferably 4% to 20% by weight of L1, generally supercooled by at least 20° C. Alternately, absorption liquid AL2 can comprise or be constituted by a liquid fraction L2 that represents 3% to 40% by weight of L2, and very preferably 4% to 20% by weight of L2, generally supercooled by at least 20° C.

Finally, absorption liquid AL2 can comprise or be constituted by a fraction of liquid L3 that represents 3% to 40% by weight of L3, and very preferably 4% to 20% by weight of L3, generally supercooled by at least 20° C.

The invention relates in particular to the use of the above-mentioned process for treatment of a hydrocarbon feedstock that comprises a hydrocarbon-containing liquid phase and a hydrogen-rich gaseous phase, with all of the above-mentioned variants, for hydrocarbon-reforming effluent treatment, so as to produce a stabilized reformate L4*a*, and a light liquid stream L4*b* that essentially comprises propane and butane. The invention makes it possible to separate and to send to the fuel gas network a light gas that comprises the bulk of the methane and ethane produced, whereby this fuel gas is low in LPG. It also makes it possible to be able to produce a high-purity hydrogen gas, for example, with an H2 content of between 85% and 99%, in particular between 90 and 98 mol % of hydrogen, for example between 94 and 97 mol % of hydrogen.

The invention will be described in more detail following the description of FIG. 1 and the operation of the corresponding installation.

Description of FIG. 1:

In the non-limiting embodiment of FIG. 1, the feedstock of the treatment unit according to the invention is the effluent that is obtained from the conversion zone of a catalytic reforming. This feedstock is cooled then fed via a pipe F into gas/liquid separation means S intended to recover a hydrogen-rich gas G1 that is evacuated via line $\mathbf{1}_B$ and a liquid hydrocarbon effluent L1 that is evacuated via line $\mathbf{1}_A$.

L1 is typically the liquid that is obtained in the "cold tank" of the reforming loop, after cooling and partial condensation of the effluent at a temperature that is generally close to ambient temperature: [15° C.-60° C.]. The pressure at separation level L1/G1 is typically between 0.2 and 0.5 MPa for modern reforming units (at low pressure) and often between 0.5 and 2 MPa and even more for the older units.

Gas G1 is typically the purging gas of reforming, not the recycling gas. Gas G1 that is shown in FIG. 1 therefore does not actually represent all of the gas that is evacuated from tank S, but only excess gas compressed at high pressure (or purging gas for reforming). A significant quantity of recycling gas of the reforming loop also moves through tank S and is not shown in FIG. 1. Gas G1 is compressed in compressor K, for example a multi-stage centrifugal compressor, up to a pressure of, for example, about 1.8 MPa, then cooled in heat exchanger E2, for example at 45° C., then fed via line $\mathbf{1}_B$ to contact column 2 that operates under 1.6 MPa. In this column, compressed gas G1 (G1*), from which a portion of the heaviest compounds, typically condensed in E2 and separated in the lower portion of column 2, is removed, is brought into counter-current contact with a cooled absorbent liquid AL1 that is fed into column 2 via line $\mathbf{1}_A$. This liquid consists of part or all of liquid L1 that is obtained from cold tank S, evacuated via line $\mathbf{1}_A$, which is pumped (by a pump, not shown) at a pressure that is slightly above the pressure of column 2, then cooled to a temperature such as 0° C. or −10° C. in heat exchanger E1. This cooled liquid AL1 feeds column 2 in the upper portion via line $\mathbf{1}_A$ and absorbs a significant quantity of C1 to C4 hydrocarbons that are initially present in gas G1*. Optionally and preferably, it is also possible to send a first portion of L1 (not cooled), for example 50 to 70% by weight, mixed with gas G1, upstream from exchanger E2, to increase the quantity of hydrocarbons that are present in G2 that are already condensed at the inlet of column 2. It is then advantageous to significantly cool the mixture in E2, for example between +10° C. and +20° C. This also reduces the power of the cooling group that is necessary for cooling the second portion of L1 (AL1) that is cooled more intensely in exchanger E1. This possibility of unstabilized reformate injection upstream from E2 is not shown in FIG. 1.

Column 2 (as also columns 12 and 31 that are described below) can comprise perforated plates or cap plates or any other kind of contact plate, or else packings, which may or may not be structured (pall rings, raschig rings, etc.). It can have a number of theoretical separation stages, generally between 2 and 12 and most often between 3 and 6.

Gas G2, evacuated from column 2 via line 3, is a high-purity gas that is very rich in hydrogen. Actually, absorption liquid L1, obtained at low pressure, is low in light hydrocarbons. After cooling, its absorption capacity at an elevated pressure such as 1.6 MPa is very high.

Liquid L2 that is obtained from column 2 is evacuated via line 4 then contact column 12 is fed with a recycled gas stream G4 for a high recovery of LPG, and an evacuation of methane and ethane. Column 12 typically comprises two gas/liquid counter-current contact zones 6 and 7 with a liquid AL2.

According to a first contact option, shown in FIG. 1, absorption liquid AL 2 essentially comprises a portion of cooled liquid L1: it is possible to introduce via line 11 a portion of cooled liquid L1, for example 3% to 40%, in particular 6% to 32% by weight of L1,in order to feed column 12, or contact is made for the recovery of LPG from recycled gas G 4.

According to a second contact option, a fraction of liquid L2, or all of L2, can feed column 12 in intermediate position via line 4, for example between the two contact zones of column 12 that are shown in FIG. 1. Absorption liquid AL then comprises a portion of uncooled liquid L2. According to a variant, part or all of L2 circulates in line 5, is cooled in heat exchanger E3, then feeds column 12, for example, in the upper portion via line 11. Absorption liquid AL2 then comprises a portion of cooled liquid L2.

According to a third contact option, liquid L3 that is obtained from contact column 12 is used as absorption liquid AL2: it then circulates in line 10, is cooled in exchanger E4, then feeds column 12 in the upper portion.

Liquids L2 and L3 can be cooled in the same temperature ranges as indicated above with regard to L1.

Counter-current absorption, typically essentially at isopressure, by at least a fraction of unstabilized liquid L1, L2, L3 that is typically cooled, makes it possible to obtain a high recovery of LPG, while evacuating a gas that is high in methane and ethane and low in LPG at the top of column 12, via line 13.

The process according to the invention makes it possible to obtain a noteworthy or significant recovery of LPG from recycled gas G4 that is fed via line 42 at the bottom of column 12 and to prevent an excessive increase in the circulation of methane and primarily ethane, as well as the circulation of propane and butane at downstream stabilization column 31.

The diagram that is shown in FIG. 1 is given only by way of indication and can be modified easily by one skilled in the art. For example, it is possible to eliminate the lower contact zone of column 12 and to make direct contact by in-line mixing between G4 and part or all of L2, in line 4, typically immediately upstream from column 12.

The main variant embodiments according to FIG. 1 are as follows:

1) A portion of liquid L1, preferably cooled, is fed to the top of column 12 (via line 11); uncooled liquid L2 feeds column 12 via line 4.

2) Part or all of cooled liquid L2 is fed to the top of column 12 (via line 11); uncooled (optional) residual liquid L2 feeds column 12 via line 4.

3) A portion of cooled liquid L3 is fed to the top of column 12 (via line 10); uncooled liquid L2 feeds column 12 via line 4.

For each of these three variants, there are two main possibilities for contact of gas G4:

a) Gas G4 is introduced as shown in FIG. 1, below a counter-current contact zone 6.

b) Contrary to the representation of FIG. 1, gas G4 is mixed in-line with at least a portion of liquid L2, typically in the end portion of line 4, just upstream from column 12. G4 feed line 42 is therefore connected to line 4 and not to column 12. In this option, lower contact zone 6 is typically eliminated.

According to the invention, the "bubble point" of AL1 or AL2 is the bubble point (temperature of the appearance of a vapor phase) at the inlet pressure in the above-mentioned corresponding contact and separation means (2 and 12).

In the zone for absorption by AL2, column 12 can have a number of theoretical separation stages generally included between 1.5 and 8, and most often between 2 and 5. It can also have a reboiling at the bottom of the column, not shown in FIG. 1, to eliminate a noteworthy or significant portion of methane and ethane from the liquid that comes out at the bottom of the column.

A portion of liquid L3 is sent, via evacuation pipe 8, to heater E5, then via line 9 to a stabilization unit 21, intended to recover a stabilized reformate and a liquefied petroleum gas.

Stabilization device 21 comprises a distillation column 31. The base of column 31 is provided with a circulation pipe 32 that is equipped with a recirculation circuit that comprises a reboiler E7 and an evacuation pipe 34 of stabilized reformate $L4_A$. The gas at the top of column 31 circulates in a pipe 35 that is connected to a partial condenser E6, then joins a reflux tank 37 via line 38. The liquid that is separated in the reflux tank is evacuated via pipe 39, whereby a portion is recirculated to the column via line 40, and complement $L4_B$ (comprising for the most part or essentially LPG) is evacuated via line 41. Residual gas G4, not condensed in the reflux tank and comprising significant quantities of LPG, is evacuated via line 42 and recycled as indicated above (toward column 12 or line 4).

The operation of the installation makes it possible to produce, by cold absorption by a particular supercooled absorbent, a "cold point" that is often between −15° C. and +10° C. on the top gas or gases of columns 2 and/or 12 to lose as little LPG as possible without using stabilized reformate, whose fractionation for recycling is expensive.

Example 1 for Comparison:

A catalytic reforming effluent that exits under a pressure of 0.5 MPa is fed into an installation of the prior art according to a process that is not in accordance with that of the invention, for which the pieces of equipment differ from those of FIG. 1 in that pieces of equipment 2 and 12 are not columns but simple gas/liquid separator tanks that are fed at an ambient temperature of 31° C. Lines $1_A$ and $1_B$ are then merged at the inlet of the separator tank that replaces column 2. In an analogous way, column 12 is replaced by a simple separator tank; lines 5, 11 and 10 are eliminated, and gas G4 is mixed in line 4 that is upstream from the separator tank with liquid L2, at 31° C., that is obtained from the first separator tank. The flows that enter into the separator tank are provided in Table 1:

TABLE 1

| Kg/h | Input (5) | Liquid Output (8) | Gas Output (13) |
|---|---|---|---|
| H2 | 29 | 10 | 19 |
| C1 | 283 | 228 | 55 |
| C2 | 2382 | 2251 | 131 |
| C3 | 3613 | 3550 | 62 |
| iC4 | 1682 | 1670 | 12 |
| NC4 | 2550 | 2537 | 13 |
| C5+ | 88999 | 88983 | 16 |
| Total Kg/h | 99538 | 99229 | 309 |
| Pressure MPa | 1.6 | 1.6 | 1.6 |
| Temperature ° C. | 31 | 31 | 31 |

Example 2 According to the Invention

The installation of Example 1 is used with the consistent modification to replace the (second) separator tank by an absorption column 12. This column comprises a single absorption zone 7 with 5 theoretical stages (whereby zone 6 that is shown in FIG. 1 is eliminated). A liquid AL2 that represents 5% by mass (or 5100 kg/h) of liquid flow L3 that exits from the column via pipe 8 is sampled via line 10, cooled to −5° C. in exchanger E4 and reinjected at the top of the column. The operating conditions are indicated in Table 2.

TABLE 2

| Kg/h | Input (5) | Liquid Output (8) | Gas Output (13) |
|---|---|---|---|
| H2 | 28 | 9 | 19 |
| C1 | 312 | 251 | 60 |
| C2 | 3403 | 3307 | 94 |
| C3 | 4688 | 4658 | 34 |
| iC4 | 1990 | 1986 | 5 |
| NC4 | 2901 | 2897 | 5 |
| C5+ | 89268 | 89261 | 4 |
| Total Kg/h | 102590 | 102369 | 221 |
| Pressure MPa | 1.6 | 1.6 | 1.5 |
| Temperature ° C. | 35 | 34 | 0 |

The comparison of Tables 1 and 2 shows that the loss in LPG in the column top gas (line 13) drops from 87 kg/h to 44 kg/h by using the invention and is therefore essentially reduced by half.

The invention claimed is:

1. A process for the treatment of a hydrocarbon feedstock comprising a hydrocarbon-containing liquid phase and a hydrogen-rich gaseous phase, said process comprising a) separating the feedstock into a liquid L1 and a gas G1, under a pressure P1, b) compressing at least a portion of G1 to obtain a gas stream G1* and contacting said gas stream G1* with at least a portion of L1 under a pressure P2>2×P1, so as to recover a liquid L2 and a hydrogen-rich gas G2, c) fractionating at least a fraction of L2 to obtain at least: a stabilized liquid L4*a* that is essentially free of LPG (liquid petroleum gases) and lighter products, a light liquid stream L4*b* that essentially comprises LPG, and a gas stream G4 that is at least partly recycled, and wherein gas G1*, optionally precooled by itself or mixed with a portion of L1 to carry out a first recovery of LPG, is subjected to counter-current contact with an unstabilized liquid AL1 comprising at least in part of L1, AL1 being cooled to below +10° C. and supercooled by at least 30° C. below its bubble point at the contact pressure.

2. A process according to claim 1, in which gas G1* is first precooled in a mixture with a first portion of L1 to a temperature that is less than or equal to +10° C. to carry out a first absorption of LPG, and residual gas, after separation of the liquid that is contained in the cooled mixture, is subjected to counter-current contact with an unstabilized liquid ALl that comprises a second portion of L1, whereby AL1 is cooled to below +10° C., and supercooled by at least 30° C. below its bubble point at the contact pressure.

3. A process according to claim 1, in which liquid L2 and at least a fraction of stream G4 is subjected to gas/liquid counter-current contact with a supercooled absorption liquid AL2 for absorption of LPG so as to recover a liquid effluent L3 and a gas G3, whereby said supercooled liquid AL2 is an unstabilized liquid of the group that comprises one or more of the following liquids and fractions thereof: L1, L2 and L3; subjecting liquid L3 to distillation(s) to obtain a bottom stabilized liquid L4*a*, and an upper condensed light liquid stream L4*b* essentially comprising LPG; and said gas stream G4 is at least partly recycled.

4. A process according to claim 3, in which absorption liquid AL2 is supercooled to a temperature at least 20° C. below its bubble point at the contact pressure.

5. A process according to claim 1, in which absorption liquid AL1 comprises a fraction of liquid L1 that represents 5% to 50% by weight of L1.

6. A process according to claim 3, in which absorption liquid AL2 comprises a fraction of liquid L1 representing 3% to 40% by weight of L1.

7. A process according to claim 3, in which absorption liquid AL2 comprises at least a fraction of liquid L2 that represents 3% to 40% by weight of L2.

8. A process according to claim 3, in which absorption liquid AL2 comprises a fraction of liquid L3 that represents 3% to 40% by weight of L3.

9. A process according to claim 3, in which part or all of gas stream G4 is brought into contact with at least a portion of liquid L2, by mixing upstream from the counter-current contact with an unstabilized liquid AL2.

10. A process according to claim 1, wherein the feedstock comprises a hydrocarbon-reforming effluent, said process producing a stabilized reformate L4*a*, and a light liquid stream L4*b* that essentially comprises propane and butane.

11. A process according to claim 1, wherein AL1 is supercooled by at least 50° C. below its bubble point at the contact pressure P2.

12. A process according to claim 2, wherein AL1 is cooled below 0° C.

13. A process according to claim 2, wherein AL1 is supercooled by at least 60° C. below its bubble point at the contact pressure P2.

14. A process according to claim 6, in which absorption liquid AL2 is supercooled by at least 20° C. below its bubble point at the contact pressure P2.

15. A process according to claim 7, in which absorption liquid AL2 is supercooled by at least 20° C. below its bubble point at the contact pressure P2.

16. A process according to claim 13, in which liquid L2 and at least a fraction of stream G4 is subjected to gas/liquid counter-current contact with a supercooled absorption liquid AL2 for absorption of LPG so as to recover a liquid effluent L3 and a gas G3, whereby said supercooled liquid AL2 is an unstabilized liquid of the group that comprises one or more of the following liquids and fractions thereof: L1, L2 and L3; subjecting liquid L3 to distillation(s) to obtain a bottom stabilized liquid L4*a*, and an upper light liquid stream L4*b* essentially comprising LPG; and said gas stream G4 is at least partly recycled.

17. A process according to claim 2, in which liquid L2 and at least a fraction of stream G4 is subjected to gas/liquid counter-current contact with a supercooled absorption liquid AL2 for absorption of LPG so as to recover a liquid effluent L3 and a gas G3, whereby said supercooled liquid AL2 is an unstabilized liquid of the group that comprises one or more of the following liquids and fractions thereof: L1, L2 and L3; subjecting liquid L3 to distillation(s) to obtain a bottom stabilized liquid L4*a*, and an upper light liquid stream L4*b* essentially comprising LPG; and said gas stream G4 is at least partly recycled.

* * * * *